US006666780B2

(12) United States Patent
Watanabe

(10) Patent No.: US 6,666,780 B2
(45) **Date of Patent: *Dec. 23, 2003**

(54) GOLF BALL

(75) Inventor: Hideo Watanabe, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,119

(22) Filed: Jun. 15, 2001

(65) Prior Publication Data

US 2002/0032077 A1 Mar. 14, 2002

(30) Foreign Application Priority Data

Jun. 26, 2000 (JP) ..... 2000-190638

(51) Int. Cl.[7] ..... A63B 37/04; A63B 37/06; A63B 37/08; A63B 37/00

(52) U.S. Cl. ..... 473/373; 473/374; 473/351; 473/370

(58) Field of Search ..... 473/351–377

(56) References Cited

U.S. PATENT DOCUMENTS

| | | | | |
|---|---|---|---|---|
| 5,002,281 A | * | 3/1991 | Nakahara et al. | 473/373 |
| 5,072,944 A | * | 12/1991 | Nakahara et al. | 473/373 |
| 5,184,828 A | | 2/1993 | Kim et al. | |
| 5,645,496 A | | 7/1997 | Endo et al. | |
| 5,711,723 A | | 1/1998 | Hiraoka et al. | |
| 5,803,833 A | * | 9/1998 | Nakamura et al. | 473/377 |
| 5,830,085 A | * | 11/1998 | Higuchi et al. | 473/373 |
| 6,045,459 A | * | 4/2000 | Sugimoto et al. | 473/373 |
| 6,190,269 B1 | * | 2/2001 | Moriyama | 473/373 |
| 6,287,218 B1 | * | 9/2001 | Ohama | 473/377 |
| 6,315,682 B1 | * | 11/2001 | Iwami et al. | 473/370 |
| 6,319,155 B1 | * | 11/2001 | Moriyama et al. | 473/371 |
| 6,336,872 B1 | * | 1/2002 | Moriyama et al. | 473/374 |
| 6,354,967 B1 | * | 3/2002 | Nakamura et al. | 473/377 |
| 6,358,159 B1 | * | 3/2002 | Yamagishi et al. | 473/374 |
| 6,379,268 B1 | * | 4/2002 | Yamagishi et al. | 473/371 |
| 6,390,935 B1 | * | 5/2002 | Sugimoto | 473/373 |

FOREIGN PATENT DOCUMENTS

| | | |
|---|---|---|
| JP | 10-127823 | 5/1998 |
| JP | 11/290479 | 10/1999 |
| JP | 11-333026 | 12/1999 |

OTHER PUBLICATIONS

Farrally, M.R. et al., Science and Golf III: Proceedings of the World Scientific Congress of Golf. Illinois: Human Kinectics, copyright 1999, p. 413.*

* cited by examiner

*Primary Examiner*—Steven Wong
*Assistant Examiner*—Alvin A. Hunter, Jr.
(74) *Attorney, Agent, or Firm*—Sughrue Mion, PLLC

(57) ABSTRACT

A multi-piece golf ball includes a rubbery elastic core, a cover having a plurality of dimples on the surface thereof, and at least one intermediate layer between the core and the cover. The intermediate layer is composed of a resin material which is softer than the cover. The elastic core has a hardness which gradually increases radially outward from the center to the surface thereof. The center and surface of the elastic core have a hardness difference of at least 21 JIS-C hardness units. This construction and combination of features improve the rebound energy, travel distance, durability and feel of the ball.

5 Claims, 1 Drawing Sheet

GOLF BALL

BACKGROUND OF THE INVENTION

1. Field of the Invention

The present invention relates to a golf ball having a multilayer construction of at least three layers which includes a core, an intermediate layer and a cover. More particularly, the invention relates to a golf ball which has good rebound characteristics and provides an excellent travel distance, durability and "feel" upon impact with a golf club.

2. Prior Art

In recent years, solid golf balls, with their good flight performance, have consistently won greater general approval than conventional thread-wound golf balls.

Solid golf ball constructions include two-piece balls made of a solid, high-resilience, rubber core enclosed within a relatively thin resin cover, and multi-piece balls having a core, a cover, and also an intermediate layer therebetween whose properties differ somewhat from those of the cover.

As already noted, because of their good flight performance (i.e., long travel distance), solid golf balls of these types are widely favored mainly by amateur golfers. Yet, there remains a desire among golfers for even better flight performance.

SUMMARY OF THE INVENTION

It is therefore an object of the present invention to provide a golf ball having a multilayer construction of three or more layers that has satisfactory rebound characteristics and is endowed with improved distance without diminishing the durability and feel that are so important to average golfers.

Accordingly, the invention provides a golf ball comprising a rubbery elastic core having a center and a radially outer surface, a cover having a plurality of dimples on the surface thereof, and at least one intermediate layer situated between the core and the cover. The intermediate layer is composed of a resin material which is softer than the cover. The elastic core has a hardness which gradually increases radially outward from the center to the surface thereof, and a difference in JIS-C hardness of at least 21 between the center and the surface.

Preferably, the JIS-C hardness at the center of the core is 40 to 60, and the JIS-C hardness at the surface of the core is 70 to 90. The core typically undergoes a deformation of 3.5 to 6.0 mm when the load applied thereto is increased from an initial load of 98 N (10 kgf) to a final load of 1,275 N (130 kgf). The intermediate layer is preferably formed of an intermediate layer material containing at least 30% by weight of a thermoplastic polyester elastomer.

BRIEF DESCRIPTION OF THE DRAWING

The objects, features and advantages of the invention will become more apparent from the following detailed description, taken in conjunction with the accompanying diagram.

The only FIGURE.

DETAILED DESCRIPTION OF THE INVENTION

Figure 1:
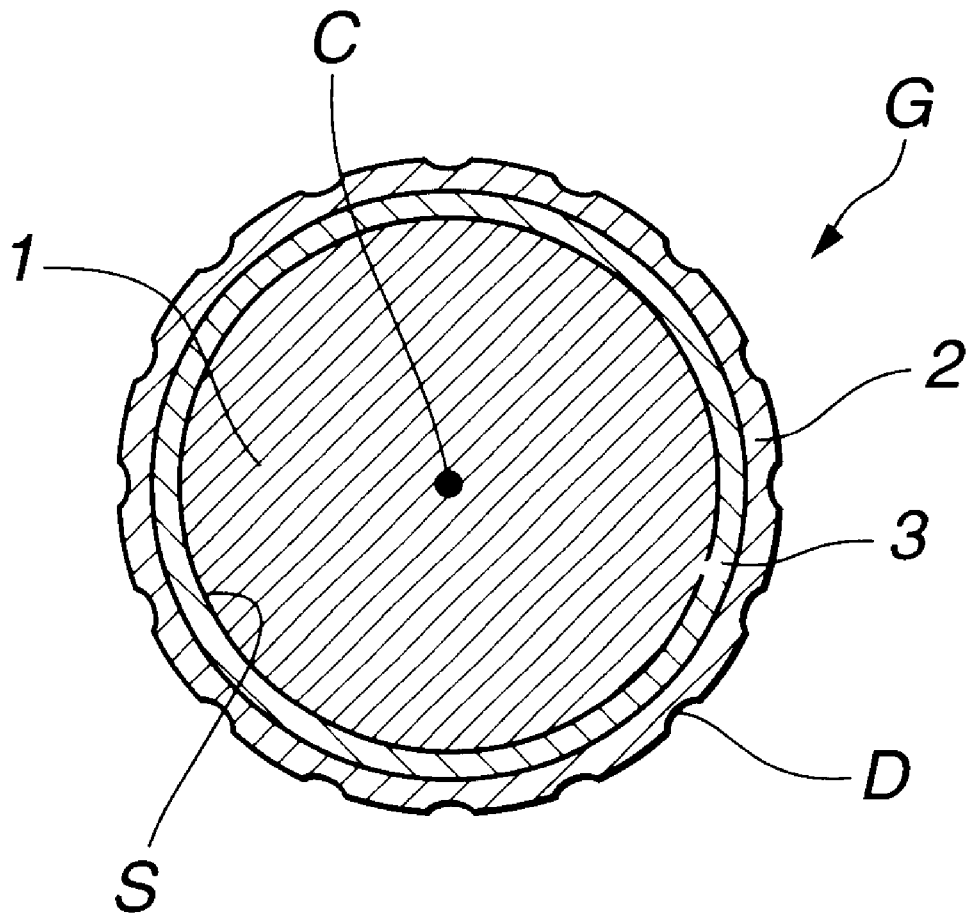
FIG. 1 is a sectional view showing a golf ball according to one embodiment of the invention.

Referring to FIG. 1, the golf ball G of the present invention has a construction composed of at least three layers, commonly known as a "multi-piece construction," which include a rubbery elastic core 1, a cover 2 that is generally made of a resin material and has a plurality of dimples D on the surface thereof, and one or more intermediate layer 3 between the core 1 and the cover 2, all situated in a concentric fashion. The illustrated embodiment has a single intermediate layer. The intermediate layer 3 is made of a resin material which is softer than the cover 2. The core 1 having a center C and a surface S at its radially outer extremity has a JIS-C hardness which gradually increases radially outward from the center C to the surface S. The hardness at the core surface S is higher than the hardness at the core center C. The core 1 is formed so as to have a specific hardness difference between the surface S and the center C.

In the golf ball of the present invention, the core may be made from a known core material which is prepared by blending, for example, a base rubber, the metal salt of an unsaturated carboxylic acid, and an organic peroxide.

The base rubber is preferably polybutadiene. The use of 1,4-polybutadiene, and especially one having a cis structure of at least 40%, is recommended. In addition to the polybutadiene, the base rubber may also include other rubbers such as natural rubber, polyisoprene rubber and styrene-butadiene rubber, if necessary.

Examples of suitable metal salts of unsaturated carboxylic acids include zinc dimethacrylate and zinc diacrylate. Zinc diacrylate is especially preferred for achieving a high rebound energy. It is advantageous to include such unsaturated carboxylic acids in an amount of at least 15 parts by weight, and preferably at least 20 parts by weight, but not more than 50 parts by weight, and preferably not more than 45 parts by weight, per 100 parts by weight of the base rubber.

Examples of suitable organic peroxides include 1,1-bis(t-butylperoxy)-3,3,5-trimethylcyclohexane, dicumyl peroxide, di-(t-butylperoxy)-m-diisopropylbenzene and 2,5-dimethyl-2,5-di-t-butylperoxyhexane. It is advantageous to include such peroxides in an amount of at least 0.1 part by weight, and preferably at least 0.5 part by weight, but not more than 5 parts by weight, and preferably not more than 2 parts by weight, per 100 parts by weight of the base rubber.

If necessary, the core material may include also various additives such as inorganic fillers and antioxidants. Illustrative examples of such additives include zinc oxide, barium sulfate and calcium carbonate.

To impart good rebound characteristics, it is advisable to include a suitable compounding ingredient such as a thiophenol, thionaphthol, halogenated thiophenol or metal salt thereof in the core material. Specific examples of such compounding ingredients that may be used include pentachlorothiophenol, pentafluorothiophenol, pentabromothiophenol, p-chlorothiophenol and the zinc salt of pentachlorothiophenol. The zinc salt of pentachlorothiophenol is especially preferred. Such a compounding ingredient is typically included in an amount of at least 0.4 part by weight, and preferably at least 0.6 part by weight, but not more than 2.0 parts by weight, and preferably not more than 1.2 parts by weight, per 100 parts by weight of the base rubber. Too much of this ingredient tends to lower the core hardness, which can adversely impact the feel of the ball when hit as well as its durability (cracking resistance), whereas too little may lower the rebound energy of the core, making it impossible for the ball to achieve a sufficient carry.

The core may be fabricated from the above core material by using a conventional process to blend the various ingredients and mold the resulting mixture. For example, the constituent ingredients may be blended in a suitable apparatus such as a Banbury mixer or a kneader to form a "slug," which is then placed in a mold where it is vulcanized at a temperature of generally at least 150° C., and preferably at least 160° C., but generally not more than 190° C., and preferably not more than 180° C. The period of vulcanization is generally at least 8 minutes, and preferably at least 12 minutes, but generally not more than 20 minutes, and preferably not more than 16 minutes.

The weight and diameter of the core may be suitably adjusted according to such factors as the constituent materials and thickness of the intermediate layer and the cover, which are described subsequently. It is recommended that the core generally have a weight of at least 23 g, and preferably at least 29 g, but not more than 35 g, and preferably not more than 33 g. It is also recommended that the core generally have a diameter of at least 32 mm, and preferably at least 34 mm, but not more than 38 mm, and preferably not more than 36 mm.

It is critical for the core to have an optimized hardness profile in which the hardness gradually increases radially outward from the center toward the outside edge or surface of the core. That is, the core has a higher hardness at the surface than at the center.

The core center and the core surface or outside edge are depicted in FIG. 1 at C and S, respectively. The core center C and surface S must have a difference between their respective measured JIS-C hardnesses of at least 21, preferably at least 22, and most preferably at least 23 units. Too small a difference in JIS-C hardness between the relatively soft center and the relatively hard surface of the core allows the ball to take on too much spin, so that especially when hit with a driver (number 1 wood) to send the ball a distance, the carry remains substantially unchanged, but the run after landing on the ground becomes short. This makes it impossible to achieve the desired distance. This tendency becomes outstanding particularly with a flat hardness distribution entailing a hardness difference of less than 5 units. It is recommended that the upper limit in the hardness difference be at most 30, preferably 27 or less, and most preferably 25 units or less.

Specifically, the core at the center typically has a JIS-C hardness of at least 40, and preferably at least 50, but not more than 60, and preferably not more than 58. The core at the surface typically has a JIS-C hardness of at least 70, and preferably at least 75, but not more than 90, and preferably not more than 85. Too low a JIS-C hardness at the core center may deaden the feel and fail to achieve the desired rebound energy, whereas a hardness that is too high may result in an excessively hard feel when the ball is hit. Similarly, too low a JIS-C hardness at the core surface may deaden the feel of the ball when hit, while too high a hardness may result in too hard a feel.

Since the core has a hardness gradually increasing radially outward from the center to the surface thereof and an optimized difference in hardness between the center and the surface where the core is hardest, the inventive golf ball having the above-described core functions to suppress the generation of excessive spin when it is hit with a driver, effectively increasing the run after it lands on the ground, and thus travelling a longer total distance.

Preferably the core of the inventive golf ball has a deformation of at least 3.5 mm, and preferably at least 3.9 mm, but not more than 6.0 mm, and preferably not more than 5.0 mm, when the load applied thereto is increased from an initial load of 98 N (10 kgf) to a final load of 1,275 N (130 kgf). Too small a deformation may increase the spin when the ball is hit with a driver, preventing the desired travel from being achieved, and may also give the ball too hard a feel. On the other hand, too much deformation may deaden the feel and fail to achieve the necessary rebound energy.

The intermediate layer 3 of the inventive golf ball is a layer which is situated between the core 1 and the cover 2 of the ball G, as shown in FIG. 1, and is made of a resin material that is softer than the cover material. Since the relatively soft intermediate layer intervenes between the core having the optimized hardness profile and the relatively hard cover to be described later, the inventive golf ball is durable, has an optimum hardness profile as a whole, and gives a soft pleasant feel when hit with any club selected from a driver to a putter.

It is recommended that the intermediate layer be made of flexible, resilient materials. Suitable exemplary materials include ionomer resins, thermoplastic elastomers, and mixtures thereof. The thermoplastic elastomers include, for example, polyester, polyamide, polyurethane, polyolefin and polystyrene elastomers, with the thermoplastic polyester elastomers being especially preferred. It is preferred to compound at least 30%, especially at least 50% by weight of such thermoplastic polyester elastomer in the intermediate layer-forming material. An intermediate layer material with less thermoplastic elastomer may lead to insufficient ball material comprising the thermoplastic polyester elastomer, the balance may be another thermoplastic elastomer as mentioned above or ionomer resin.

The intermediate layer can be formed over the surface of the core using a known process, preferably an injection molding process. For example, once the core is placed within a mold, the intermediate layer material is injection molded over the core in a conventional manner.

The intermediate layer must have a lower hardness than the cover. It is recommended that the intermediate layer itself have a Shore D hardness of generally at least 30, and preferably at least 40, but not more than 50, and preferably not more than 47. It is generally advantageous for the intermediate layer and the cover to have a Shore D hardness difference of at least 5, and preferably at least 15 units, but not more than 35, and preferably not more than 25 units. If the intermediate layer has a hardness which is the same as or higher than that of the cover, the feel of the ball when hit may be aggravated, and the travel distance may become short especially in the low head speed region with a head speed of less than 40 m/s.

As already noted, the intermediate layer situated between the core and the cover in the golf ball of the invention is softer than the cover. The hardnesses of the intermediate layer and the core, when compared using the same hardness scale (i.e., JIS-C hardness or Shore D hardness), are preferably such that the intermediate layer has a lower hardness than the surface of the core. The JIS-C hardness difference between the core surface and the intermediate layer is preferably at least 5, and more preferably at least 10 units, but not more than 33, and more preferably not more than 25 units.

It is recommended that the intermediate layer have a thickness which is generally at least 1.0 mm, but not more than 3 mm, and especially not more than 2 mm. In cases where there are two or more intermediate layers, it is advisable to set the overall thickness of the intermediate layers within the above range.

If the golf ball has two or more intermediate layers situated between the core and the cover, the above-described hardness relationship must be maintained between the cover and the outer intermediate layer which is in close contact with the cover.

The cover of the golf ball may be formed of well-known cover materials. Examples of suitable cover materials include ionomer resins alone or in admixture with other thermoplastic elastomers. The hardness of cover material is not critical as long as it is higher than that of the intermediate layer.

A conventional process may be used to form the cover. It is especially preferable to use an injection molding process in which a solid core over which an intermediate layer has been formed is placed within a mold, and the cover material is injection molded over the intermediate layer.

It is recommended that the cover generally have a thickness of at least 1.7 mm, and preferably at least 2.0 mm, but not more than 2.5 mm, and preferably not more than 2.3 mm. Too thin a cover may lower the durability of the ball, whereas a cover that is too thick may adversely affect the ball's rebound energy or feel.

Since the golf ball of the invention has an optimized balance in hardness among the various layers as described above, the ball is endowed with an excellent rebound energy, distance performance, feel, and durability.

For competition play, the golf ball of the invention may be formed so as to have a diameter and weight which conform with the Rules of Golf. That is, the ball may have a diameter of not less than 42.67 mm and a weight of not greater than 45.93 g.

The inventive golf ball is improved in rebound energy, distance performance and durability and offers a good feel when hit.

EXAMPLES

Examples of the invention and comparative examples are given below by way of illustration, and are not intended to limit the invention.

Examples 1–3 and Comparative Examples 1–5

To ascertain the flight characteristics, feel and durability of golf balls according to one embodiment of the invention, golf balls with different hardnesses at the center and surface of the core were produced in Examples 1, 2 and 3. A number of additional examples were carried out for the purpose of comparison. The golf balls produced in Comparative Example 1 had cores with a small or flat hardness profile. The balls produced in Comparative Example 2 had cores with a noticeable, yet gradual, hardness profile. The balls produced in Comparative Example 3 had a core with a distinct hardness profile, but had an intermediate layer that was harder than the cover. The balls produced in Comparative Examples 4 and 5 similarly had cores with distinct hardness profiles, but lacked an intermediate layer. Comparative tests were conducted on these various balls.

The balls were all given the same arrangement of dimples on the surface of the cover. Namely, each ball had a total of 432 dimples of three types formed on the cover in an icosahedral arrangement.

Tables 1 and 2 below show the characteristics of the cover and intermediate layer in the ball samples in each example. Table 3 gives the characteristics of the core in the same balls, and Table 4 presents the test results obtained for each type of ball.

TABLE 1

| | | Example | | | Comparative Example | | | | |
|---|---|---|---|---|---|---|---|---|---|
| | | 1 | 2 | 3 | 1 | 2 | 3 | 4 | 5 |
| Cover | Material | a | a | a | a | a | b | a | a |
| | Thickness (mm) | 2.1 | 2.1 | 2.1 | 2.1 | 2.0 | 2.1 | 2.1 | 2.1 |
| | Hardness (Shore D) | 63 | 63 | 63 | 63 | 63 | 45 | 63 | 63 |
| Inter- | Material | c | c | c | c | c | a | — | — |
| mediate | Thickness (mm) | 1.7 | 1.8 | 1.8 | 1.7 | 1.7 | 1.8 | — | — |
| layer | Hardness (Shore D) | 40 | 40 | 40 | 40 | 40 | 63 | — | — |

TABLE 2

| Cover, intermediate layer | a | b | c |
|---|---|---|---|
| Composition (parts by weight) | | | |
| Himilan 1706 (Zn)[1] | 50 | | |
| Himilan 1605 (Na)[1] | 50 | | |
| Surlyn 8120 (Na)[2] | | 100 | |
| Hytrel 4047[3] | | | 100 |
| Titanium oxide | 5 | 5 | |
| Hardness | | | |
| Shore D hardness | 63 | 45 | 40 |
| JIS-C hardness | 92 | 71 | 63 |

[1]Ionomer resins made by DuPont-Mitsui Polychemicals Co., Ltd. Neutralizing metal is in parentheses.

[2]An ionomer resin made by E.I. DuPont de Nemours and Co. Neutralizing metal is in parentheses.

[3]A thermoplastic polyester elastomer made by DuPont-Toray Co., Ltd.

TABLE 3

| | | | | Example | | | Comparative Example | | | | |
|---|---|---|---|---|---|---|---|---|---|---|---|
| | | | | 1 | 2 | 3 | 1 | 2 | 3 | 4 | 5 |
| Core | Composition (pbw) | 1,4-cis-Polybutadiene | | 100 | 100 | 100 | 100 | 100 | 100 | 100 | 100 |
| | | Zinc diacrylate | | 37.5 | 35.0 | 33.0 | 26.0 | 26.5 | 37.5 | 31.0 | 25.7 |
| | | Peroxide (1)[1] | | 0.6 | 0.6 | 0.6 | 0.6 | 0.6 | 0.6 | 0.6 | 0.6 |
| | | Peroxide (2)[2] | | 0.8 | 0.8 | 0.8 | 0.8 | 0.8 | 0.8 | 0.8 | 0.8 |
| | | Sulfur[3] | | 0.1 | 0.1 | 0.1 | 0 | 0 | 0.1 | 0.1 | 0.1 |
| | | Antioxidant[4] | | 0 | 0 | 0 | 0.2 | 0.2 | 0 | 0 | 0 |
| | | Barium sulfate | | 16.7 | 17.7 | 18.6 | 22.2 | 22.0 | 26.1 | 15.6 | 17.9 |
| | | Zinc oxide | | 5 | 5 | 5 | 5 | 5 | 5 | 5 | 5 |
| | | Zinc salt of pentachlorothiophenol | | 1.0 | 1.0 | 1.0 | 0.2 | 0.3 | 1.0 | 1.0 | 1.0 |
| | Vulcanization conditions | Primary | Temperature (° C.) | 175 | 175 | 175 | 140 | 155 | 175 | 175 | 175 |
| | | | Time (mm) | 15 | 15 | 15 | 30 | 15 | 15 | 15 | 15 |
| | | Secondary | Temperature (° C.) | — | — | — | 165 | — | — | — | — |
| | | | Time (min) | — | — | — | 15 | — | — | — | — |
| | Hardness | Surface (JIS-C hardness) | | 83 | 78 | 75 | 74 | 74 | 83 | 76 | 84 |
| | | Center (JIS-C hardness) | | 58 | 55 | 53 | 69 | 59 | 58 | 53 | 60 |
| | | JIS-C hardness difference | | 25 | 23 | 22 | 5 | 15 | 25 | 23 | 24 |
| Deformation under loading (mm)[5] | | | | 3.9 | 4.1 | 4.5 | 3.6 | 3.7 | 3.9 | 4.5 | 3.7 |

[1]Dicumyl peroxide, produced by NOF Corporation under the trade name Percumyl D.
[2]1,1-Bis(t-butylperoxy)-3,3,5-trimethylcyclohexane, produced by NOF Corporation under the trade name Perhexa 3M-40.
[3]Zinc white-containing sulfur, produced by Tsurumi Chemical Industry Co., Ltd.
[4]Nocrack NS-6, produced by Ouchi Shinko Chemical Industrial Co., Ltd.
[5]Deformation under loading from an initial load of 98 N to a final load of 1,275 N.

TABLE 4

| | | Example | | | Comparative Example | | | | |
|---|---|---|---|---|---|---|---|---|---|
| | | 1 | 2 | 3 | 1 | 2 | 3 | 4 | 5 |
| Flight[1] | Carry (m) | 138.2 | 139.9 | 138.5 | 138.3 | 138.1 | 132.2 | 139.0 | 138.7 |
| | Total distance (m) | 154.8 | 155.2 | 156.3 | 152.5 | 153.0 | 144.8 | 156.5 | 154.1 |
| | Spin (rpm) | 3367 | 3326 | 3287 | 3587 | 3517 | 3597 | 3224 | 3457 |
| | Rating | good | good | good | poor | poor | poor | good | good |
| Feel[2] | When hit with driver | good | good | good | good | good | good | good | good |
| | When hit with putter | good | good | good | good | good | good | good | poor |
| Durability[3] | | good | good | good | good | good | good | poor | good |

[1]Flight was rated as follows, based on distance measured when ball was hit at a head speed of 35 m/s by a driver mounted on a swing robot.
Good: Total distance 154 m or more
Poor: Total distance 153 m or less.
[2]Average sensory evaluations for ten amateur golfers:
Good: Feel was soft and good.
Poor: Feel was hard.
[3]Durability was rated as follows, when ball was repeatedly hit at a head speed of 40 m/s by a driver mounted on a swing robot.
Good: no crack after 150 hits
Poor: cracked before 140 hits Japanese Patent Application No. 2000-190638 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A golf ball comprising a rubbery elastic core having a center and a radially outer surface, a cover having a plurality of dimples on the surface thereof, and at least one intermediate layer situated between the core and the cover; wherein said intermediate layer is composed of a resin material which contains at least 30% by weight of a thermoplastic polyester elastomer, and said elastic core has a hardness which gradually increases radially outward from the center to the surface thereof, and a difference in JIS-C hardness of at least 21 between the center and the surface, and said intermediate layer is softer than the cover and the surface of the core, and the JIS-C hardness difference between the core surface and the intermediate layer is from 5 to 33 units.

2. The golf ball of claim 1, wherein said core at the center has a JIS-C hardness of 40 to 60, and at the surface a JIS-C hardness of 70 to 90.

3. The golf ball of claim 1, wherein said core is formed of rubber as a base and said cover is formed of ionomer resins alone or in admixture with other thermoplastic elastomers.

4. The golf ball of claim 1, wherein said intermediate layer has a Shore D hardness of 30 to 50.

5. A golf ball comprising a rubbery elastic core having a center and a radially outer surface, a cover having a plurality of dimples on the surface thereof, and at least one intermediate layer situated between the core and the cover; wherein said intermediate layer is composed of a resin material which contains at least 30% by weight of a thermoplastic polyester elastomer, and said elastic core has a hardness which gradually increases radially outward from the center to the surface thereof, and a difference in JIS-C hardness of at least 21 between the center and the surface, and wherein the ball has two or more intermediate layers situated between the hardness relationship is maintained between the cover and the outer intermediate layer which is in close contact with the cover.

* * * * *